US007987555B2

(12) United States Patent
Chen et al.

(10) Patent No.: US 7,987,555 B2
(45) Date of Patent: Aug. 2, 2011

(54) HINGED SLIDE RAIL WITH BUFFERING FUNCTION

(75) Inventors: Wan-Lai Chen, Shulin (TW); Pi-Lan Chen, Shulin (TW)

(73) Assignee: Martas Precision Slide Co., Ltd., Taipei County (TW)

( * ) Notice: Subject to any disclaimer, the term of this patent is extended or adjusted under 35 U.S.C. 154(b) by 271 days.

(21) Appl. No.: 12/497,561

(22) Filed: Jul. 3, 2009

(65) Prior Publication Data

US 2011/0001410 A1 Jan. 6, 2011

(51) Int. Cl.

| | |
|---|---|
| ***E05F 1/08*** | (2006.01) |
| *E05F 3/20* | (2006.01) |
| *E05F 3/22* | (2006.01) |
| *A47B 88/00* | (2006.01) |

(52) U.S. Cl. ..... 16/286; 16/54; 16/50; 312/323

(58) Field of Classification Search ..... 312/323, 312/322, 327, 328, 319.2, 139, 139.1; 16/286, 16/54, 50; 49/254, 255, 256, 258
See application file for complete search history.

(56) References Cited

U.S. PATENT DOCUMENTS

| | | | | | |
|---|---|---|---|---|---|
| 1,887,102 | A | * | 11/1932 | Mathie | 312/303 |
| 3,771,847 | A | * | 11/1973 | Aylworth | 312/245 |
| RE28,994 | E | * | 10/1976 | Aylworth | 312/245 |
| 4,516,813 | A | * | 5/1985 | Sekerich | 312/323 |
| 4,620,743 | A | * | 11/1986 | Eke | 296/146.8 |
| 5,524,979 | A | * | 6/1996 | Carson et al. | 312/319.2 |
| 5,758,937 | A | * | 6/1998 | Lammens et al. | 312/328 |
| 6,296,337 | B1 | * | 10/2001 | Kawanabe | 312/319.2 |
| 6,318,824 | B1 | * | 11/2001 | LaGrotta et al. | 312/322 |
| 7,096,535 | B2 | * | 8/2006 | Lin | 16/287 |
| 7,194,785 | B2 | * | 3/2007 | Li | 16/85 |
| 7,406,749 | B2 | * | 8/2008 | Herper | 16/368 |
| 7,552,509 | B2 | * | 6/2009 | Chen et al. | 16/50 |
| 7,669,285 | B2 | * | 3/2010 | Gallasch et al. | 16/286 |
| 7,712,185 | B2 | * | 5/2010 | Pyo | 16/286 |
| 2006/0163981 | A1 | * | 7/2006 | Conrad | 312/323 |
| 2010/0319260 | A1 | * | 12/2010 | Sawa | 49/326 |

FOREIGN PATENT DOCUMENTS

| | | | |
|---|---|---|---|
| TW | 352378 | U | * 3/2009 |

* cited by examiner

*Primary Examiner* — David Dunn
*Assistant Examiner* — Ryan A Doyle
(74) *Attorney, Agent, or Firm* — Leong C. Lei

(57) ABSTRACT

A hinged slide rail with buffering function, which includes a rail to which a hinge is mounted. The hinge has a movable blade and a fixed blade between which a buffering device is coupled. The buffering device is housed in a retention frame. The retention frame has an end forming a limiting structure. The buffering device has an active rod coupled to the limiting structure. The movable blade includes a pull bar that is connected to the limiting structure. The hinged slide rail is installed between a door panel and a body of a cabinet to remarkably enhance the convenience of operation and eliminates the potential problems of generating noise and clamping and hurting users.

7 Claims, 8 Drawing Sheets

HINGED SLIDE RAIL WITH BUFFERING FUNCTION

TECHNICAL FIELD OF THE INVENTION

The present invention generally relates to a hinged slide rail structure for cabinets, and more particularly to a hinged slide rail structure that comprises a buffering device arranged between a hinge and a rail to reduce the noise induced in closing a cabinet door and protect a user from being clamped and hurt by a closing door.

DESCRIPTION OF THE PRIOR ART

Offices, laboratories, or various work sites are often provided with cabinets or lockers for storage and organization of articles. The cabinets are often provided with a door, which can turn upward or sideways, or slide sideways, for covering and closing a storage space inside the cabinet in order to realize protection and storage of the article.

A regular cabinet that is mounted to a wall uses a hinge connecting between the cabinet door panel and the cabinet body to allow the door panel to turn upward for opening. However, the door panel may be caused to swing downward due to gravity acting thereon, leading to undesired inconvenience of use. To overcome such a problem, a hinged slide rail is available in the market. As shown in FIG. 1 of the attached drawings, a hinged slide rail 10 comprises a rail 11 that has a movable plate 111 to which a hinge 12 is mounted. The rail 11 is mounted to an inside surface of a door panel 21. The hinge 12 has a movable blade 121 that is mounted to an access opening of the cabinet body 20 so as to connect the hinge 12 between the door panel 21 and the cabinet body 20. With the hinge 12, the door panel 21 may turn upward with respect to the cabinet body 20. After the door panel 21 is lifted upward, the door panel 21 can slide on a surface of the cabinet body 20 in order to horizontally position on the cabinet body 20, preventing the door panel 20 from falling and thus causing inconvenience of use. However, the operation of the hinged slide rail 10 is still disadvantageous. When the door panel 21 is pulled out, it is still subjected to the action of the gravity and thus falls down to induce a noise of impact and clamp and hurt the user.

To solve the problem, Taiwan Utility Model No. M352378 discloses a slide rail slow descending device, which is shown in FIG. 2 of the attached drawings. The slide rail slow descending device 30 comprises a hinge 31, a fixed rail 32, a telescopic buffering device 33, a movable rail 34, and a swinging element 35. The hinge 31 has an end fixed to a cabinet 40 that has an access opening. The fixed rail 32 has an end fixed to an opposite end of the hinge 31. The telescopic buffering device 33 has an end fixed to an opposite end of the fixed rail 32 and an opposite end fixed to the hinge 31. The movable rail 34 is reciprocally and slidably mounted to the fixed rail 32 and is connected to a door panel 41. The swinging element 35 is rotatably coupled between the hinge 31 and an outer side of the movable rail 34. The swinging element 35 comprises a friction section (not labeled) to abrade the outside surface of the movable rail 34. The outside surface of the movable rail 34 that corresponds to the friction section forms a recess (not shown). Through the buffering effect provided by the telescope buffering device 33 and the friction force between the swinging element 35 and the movable rail 34, the opening of the door panel 41 is made easy and convenient and effect of silencing and slow descending is realized in the closing of the door panel to avoid clamping and thus hurting users. However, the operation smoothness of sliding of the slide rail slow descending device 30 is heavily dependent upon the friction force between the swinging element 35 and the movable rail 34, and the movement stroke of the telescopic buffering device 33 imposes a great influence on the opening degree of the door panel 41. In the opening degree is over-limited or over-excessive, then inconvenience may be caused for the use and operation thereof, or even leading to damage of the door panel 41 or the cabinet body 40.

Thus, the present invention aims to provide a hinged slide rail with buffering function, which is provided with a movement limiting structure to control the opening angle of a door panel to eliminate any possible inconvenience caused in the operation thereof, so as to overcome the above discussed problems.

SUMMARY OF THE INVENTION

An objective of the present invention is to provide a hinged slide rail with buffering function for enhancing the convenience of use.

Another objective of the present invention is to provide a hinged slide rail with buffering function, which provides an effect of slow descending in closing a door panel so as to protect a user from being clamped and hurt and to eliminate the generation of noise.

To achieve the above objectives, the present invention provides a hinged slide rail comprising a rail, a hinge, a retention frame, and a buffering device. The rail comprises a fixed plate, a balled plate, and a movable plate. The balled plate and the movable plate are accommodated in the fixed plate, while the fixed plate is mounted to an inside surface of a door panel. The hinge comprises a movable blade and a fixed blade that are rotatably coupled to each other. The fixed blade is fixed to an end of the movable plate. The movable blade has an end to which a pull bar is mounted. The retention frames mounted to an end of the fixed blade of the hinge and defines therein an accommodation space. The retention frame has an end opposite to the accommodation space and forming two parallel limiting slots. The buffering device is selected among a pneumatic device, a hydraulic device, and a pneumatic/hydraulic device. The buffering device comprises an active rod having an end forming a limiting block that is slidably received in the limiting slots of the retention frame. The limiting block is coupled to the pull bar of the movable blade.

To install, the fixed plate of the rail is mounted to an inside surface of the door panel and the movable blade of the hinge is attached to an access opening of a cabinet body. When the door panel is being opened, the door panel is turned upward rotated as being supported by the pivot between the fixed blade and the movable blade of the hinge. The pull bar of the movable blade drives the limiting block to extend the active rod outward, so that the limiting block is caused to slide to an end of the limiting slots of the retention frame, making the door panel parallel to a top surface of the cabinet body. The door panel may then be pushed toward the rear side of the cabinet body so as to realize opening and stowing the door panel in a space above the top of the cabinet body. The operation is convenient and the door panel does not unexpectedly close when an article is being removed out of the cabinet, making it safe in operation and use. To close the door panel, the door panel is first pulled forward and the door panel is acted by a downward force induced by gravity. The buffering device functions to slow down the downward movement of the door panel and to allow the door panel to close gently, so as to eliminate the problem of noise generation and clamping and hurting users.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
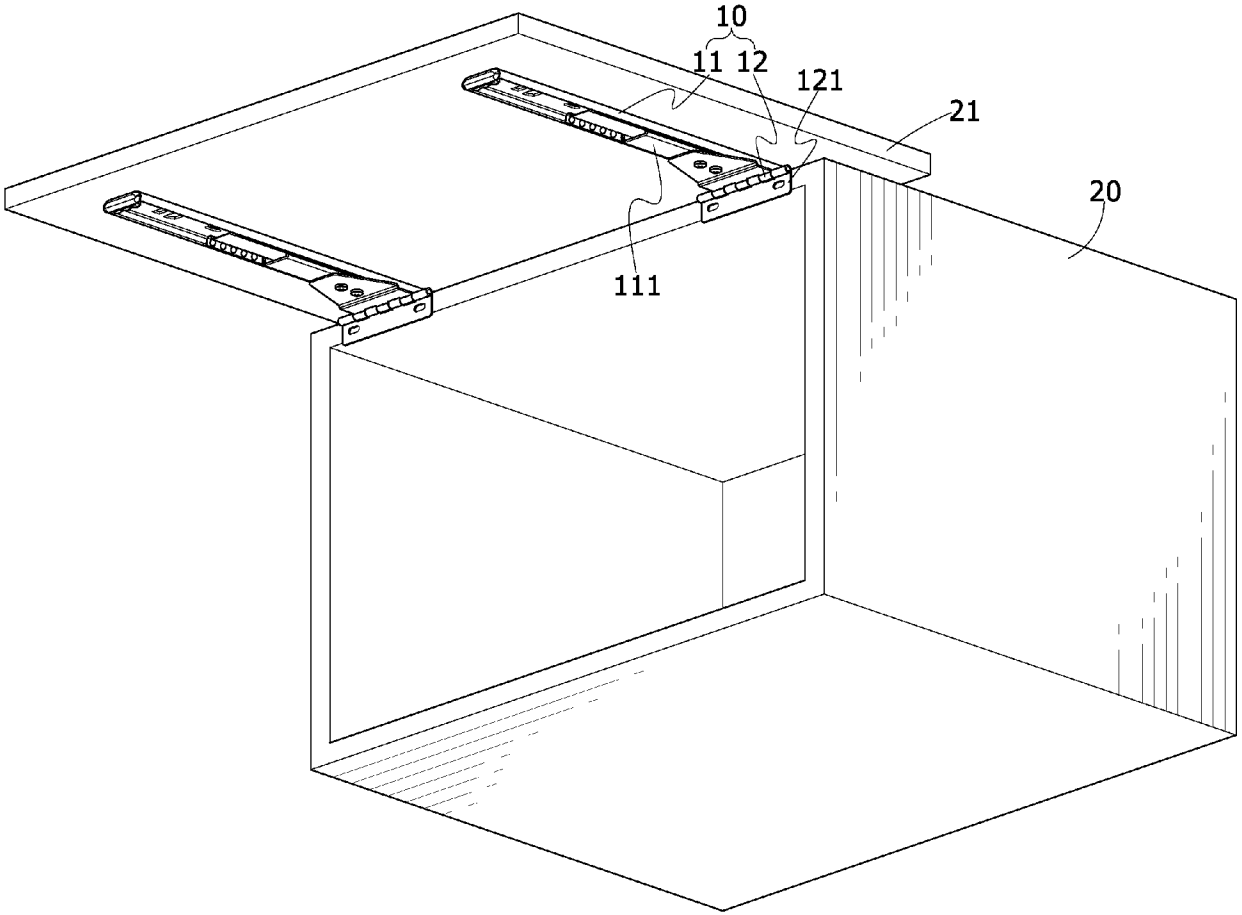
Fig.1 PRIOR ART
FIG. 1 is a schematic view illustrating the installation of a conventional hinged slide rail.
Figure 2:
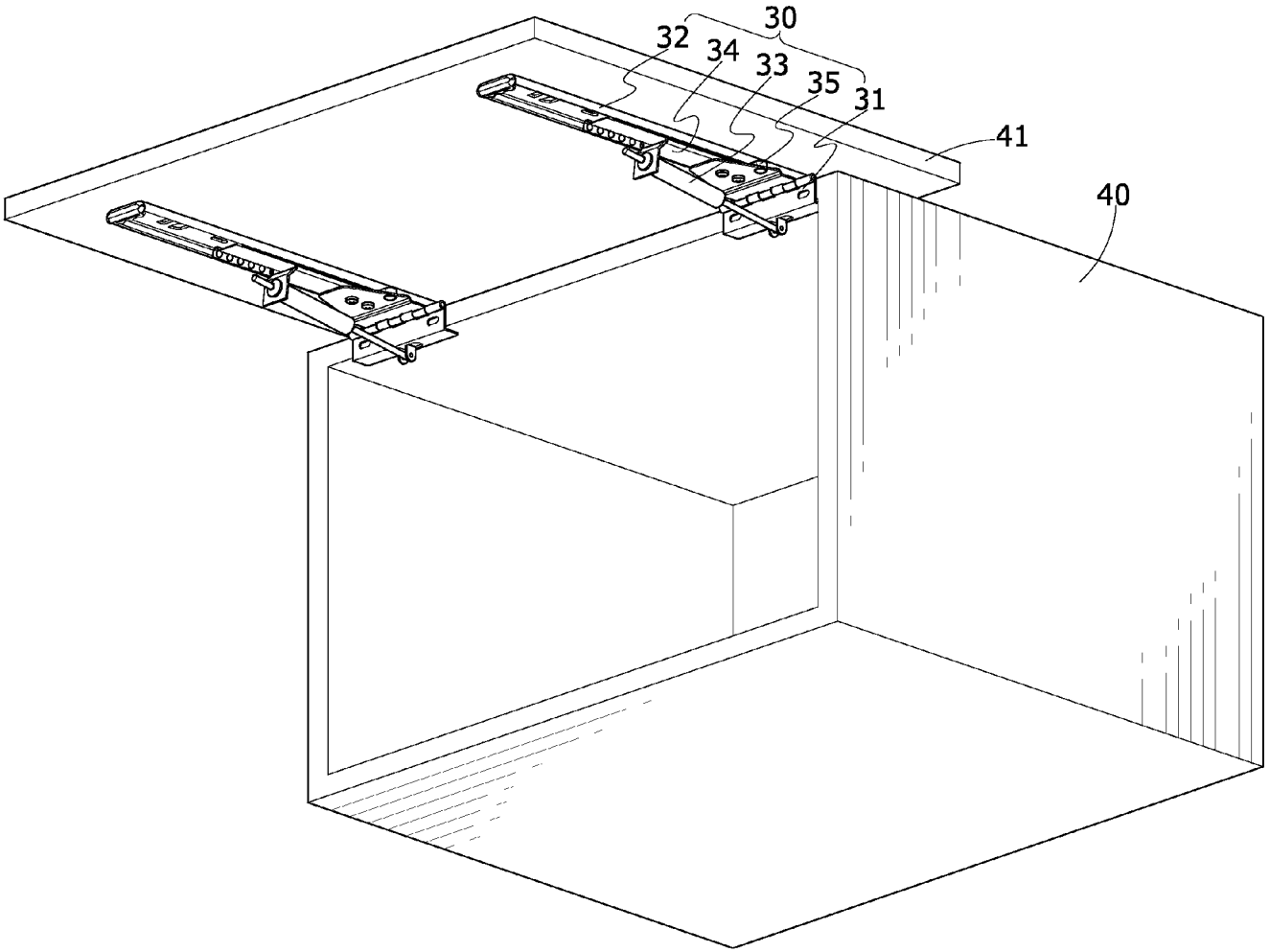
Fig.2 PRIOR ART
FIG. 2 is a schematic view illustrating the installation of a device disclosed in Taiwan Utility Model No. M352378.
Figure 3:
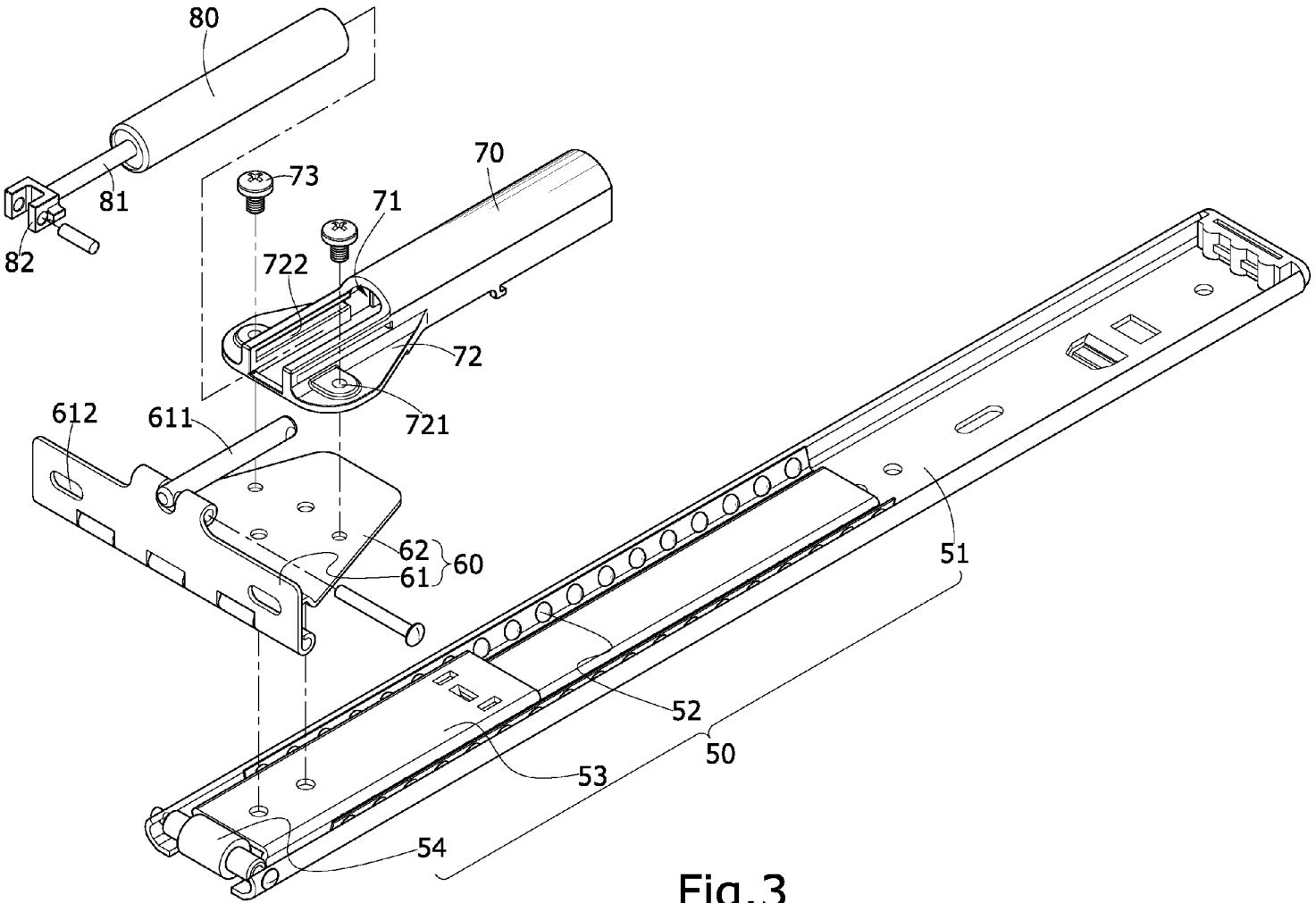
FIG. 3 is an exploded view of a preferred embodiment of the present invention.
Figure 4:
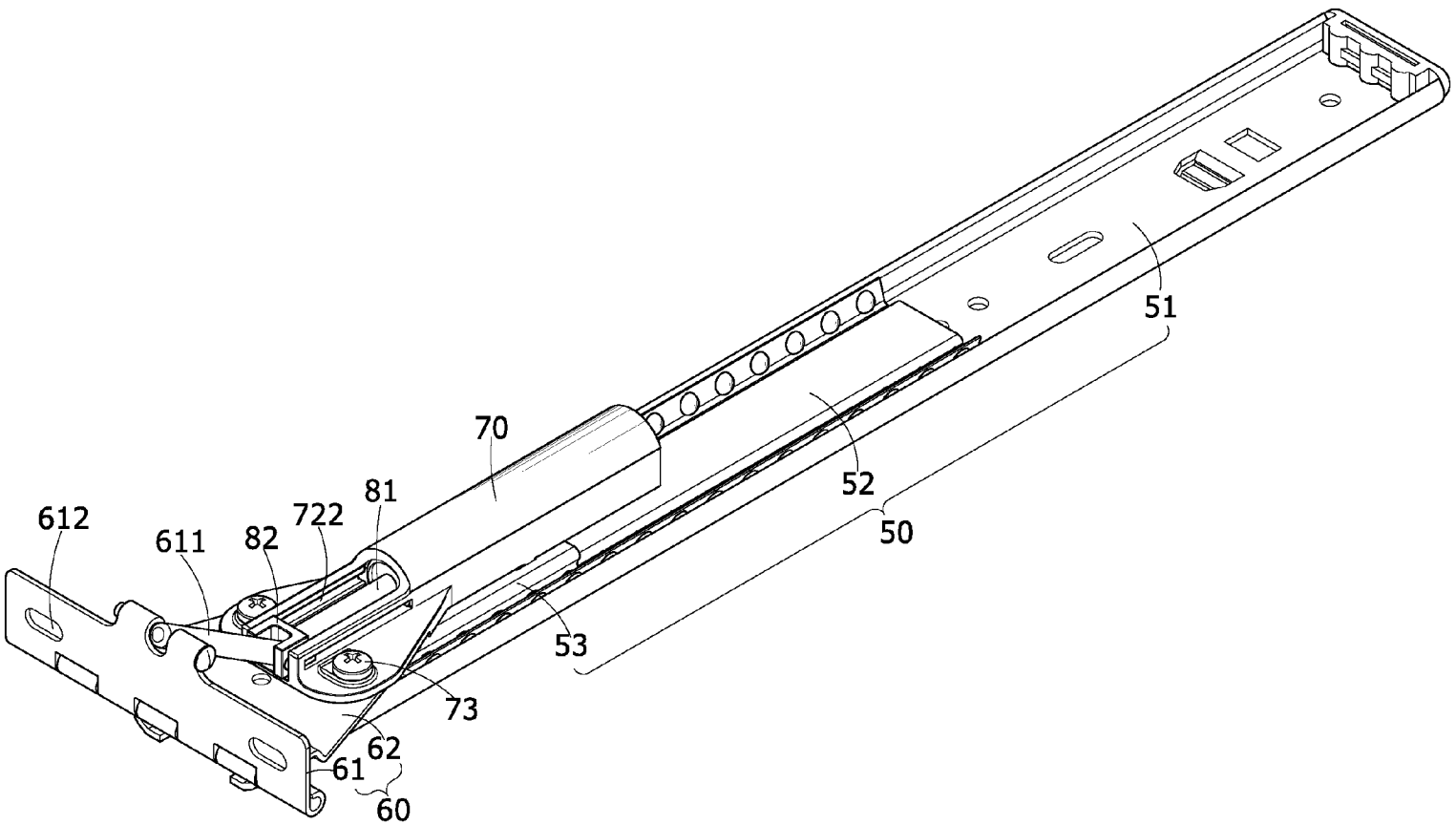
FIG. 4 is a perspective view of the preferred embodiment of the present invention in an assembled form.
Figure 5:
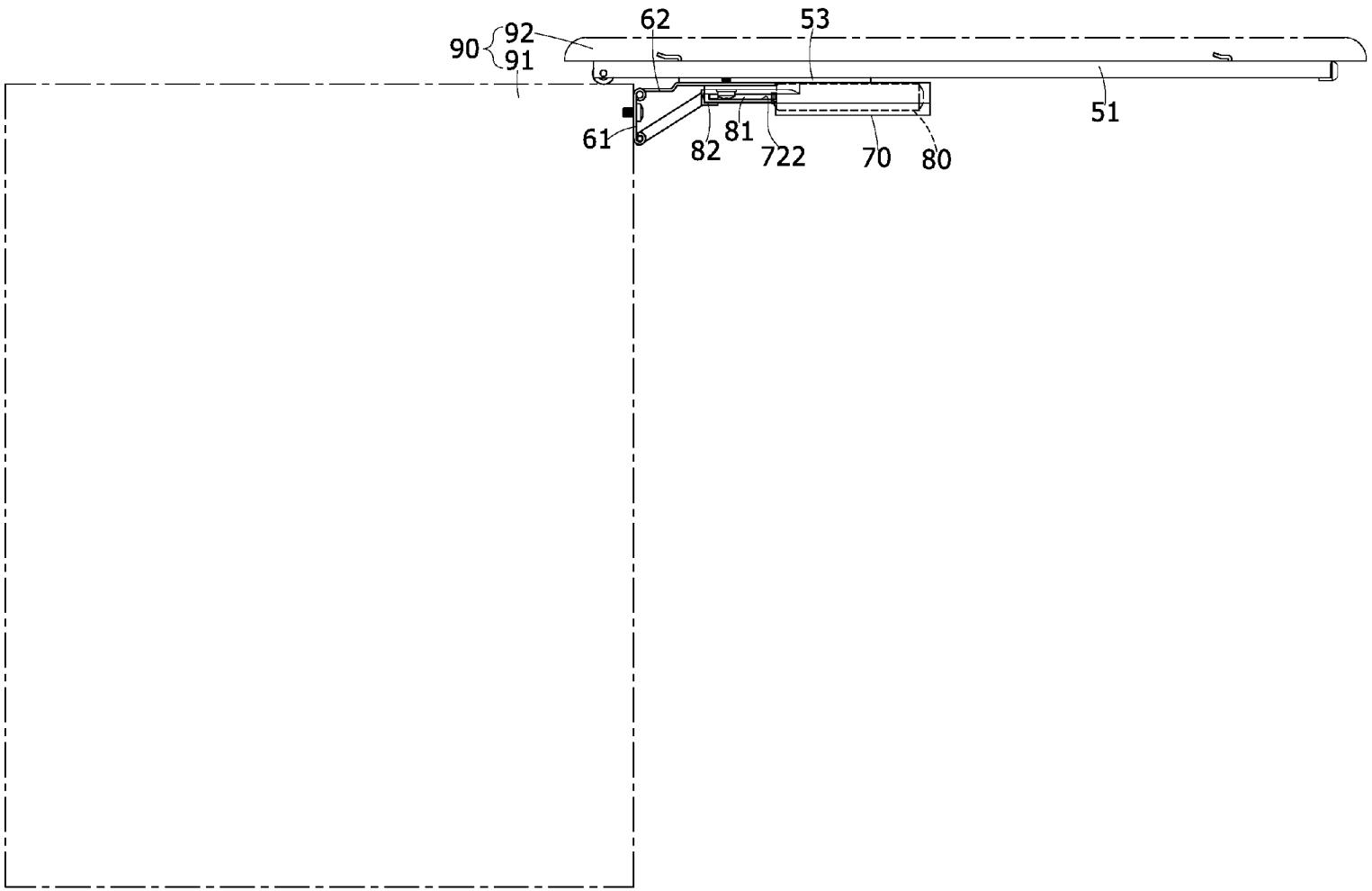
FIG. 5 is a schematic view illustrating the operation of the preferred embodiment in an initial phase of opening a door panel.
Figure 6:
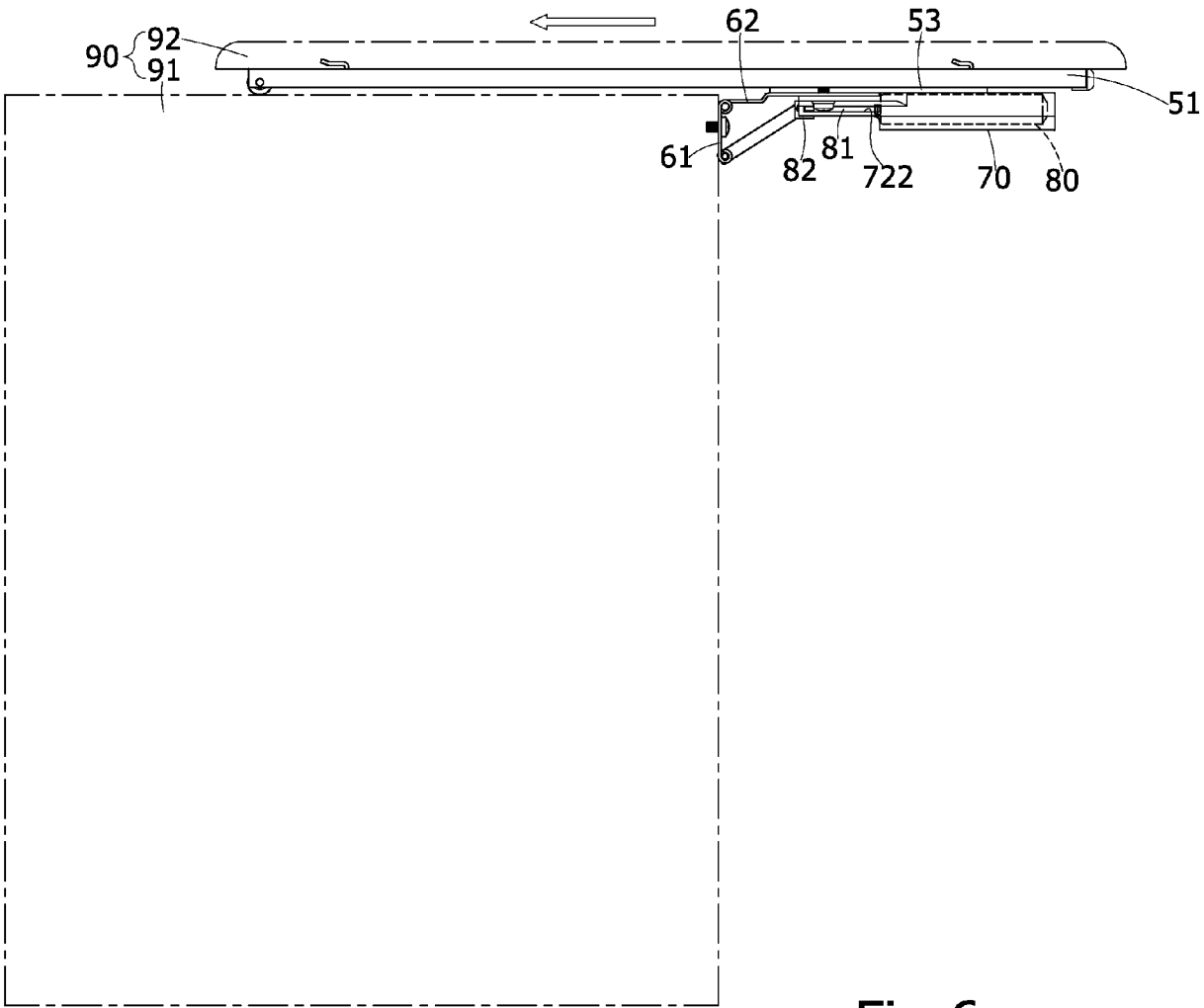
FIG. 6 is a schematic view illustrating the operation of the preferred embodiment in a subsequent phase of opening a door panel.
Figure 7:
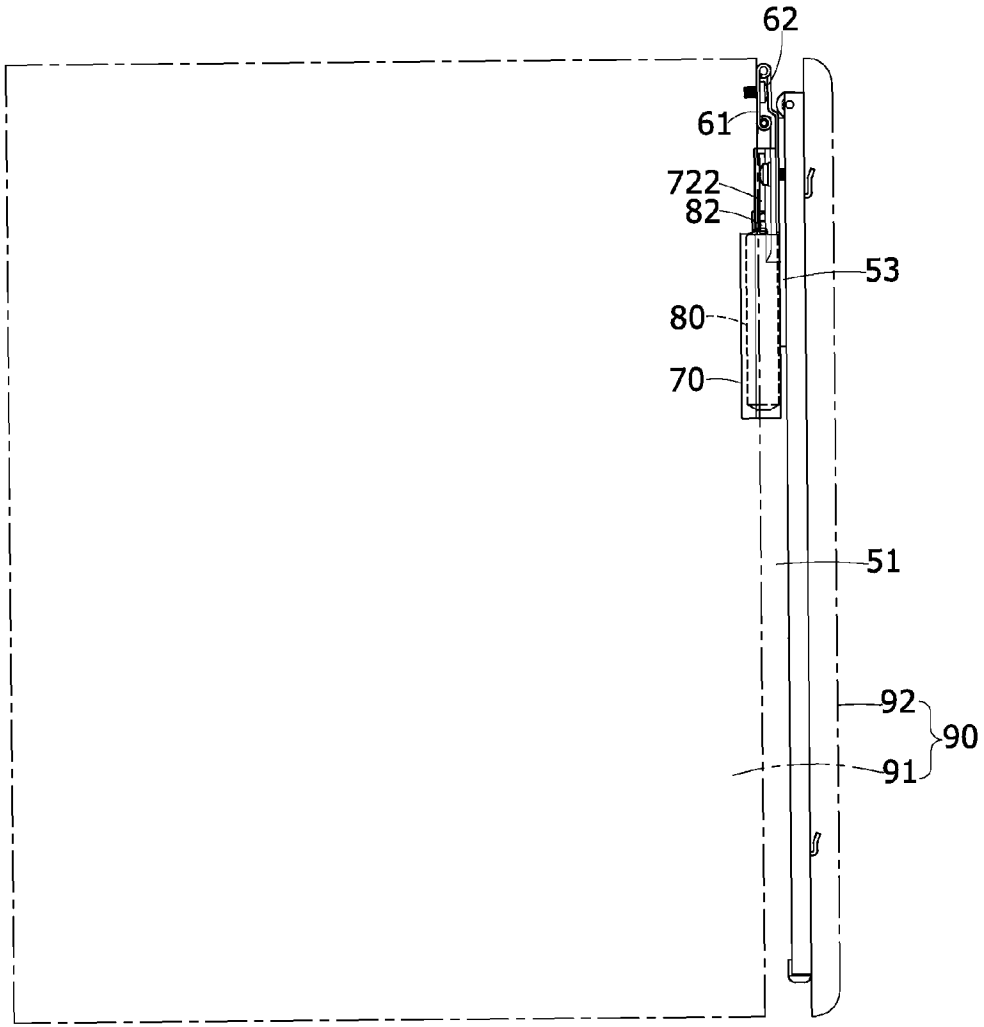
FIG. 7 is a schematic view illustrating the operation of the preferred embodiment of closing a door panel.
Figure 8:
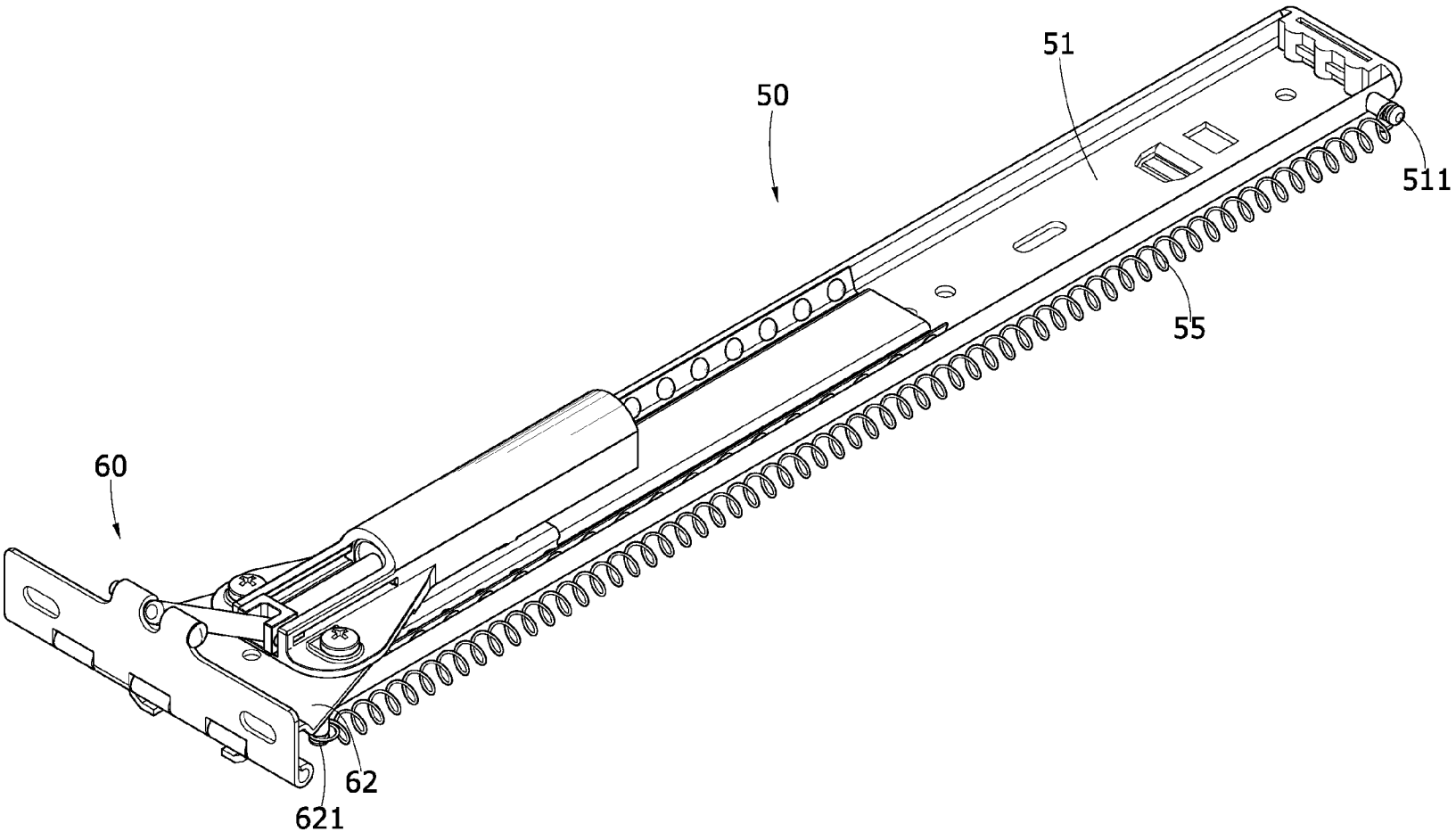
FIG. 8 is a perspective view illustrating another embodiment of the present invention.

Referring to FIGS. 3 and 4, which shows exploded and perspective views of the present invention, the present invention comprises the following constituent components:

A rail 50 comprises at least a fixed plate 51, a balled plate 52, and a movable plate 53. The balled plate 52 is interposed between the movable plate 53 and the fixed plate 51 to enhance lubrication effect between the movable plate 53 and the fixed plate 51 so as not only to allow the movable plate 53 to do reciprocal sliding movement with respect to the fixed plate 51 but also making the sliding movement smooth. The rail 50 comprises a roller 54 set at one end thereof.

A hinge 60 comprises a movable blade 61 and a fixed blade 62 that are rotatably coupled to each other so that the movable blade 61 is reciprocally rotatable with respect to the fixed blade 62. The fixed blade 62 is fixed to an end of the movable plate 53 of the rail 50. The movable blade has an opposite end to which a pull bar 611 is rotatably mounted. The movable blade 61 of the hinge forms a plurality of fixing holes 612.

A retention frame 70 has a central portion forming a cylindrical accommodation space 71 of which two sides forming lugs 72 extending therefrom to be substantially parallel to each other. The lugs 72 form at least one fixing hole 721 and one limiting slot 722 and the two limiting slots 722 are substantially parallel to each other. By inserting screws 73 through the fixing holes 721, the retention frame 70 is fixed to the movable plate 53 of the rail 50.

A buffering device 80 is selected from a group consisting of a pneumatic device, a hydraulic device, and a pneumatic/hydraulic device. In the instant embodiment, the buffering device 80 comprises a pneumatic/hydraulic device. The buffering device 80 is received in the accommodation space 71 of the retention frame 70 and has an end forming an active rod 81. The active rod 81 has an end forming a limiting block 82 that is slidably received in the limiting slots 722. The limiting block 82 is coupled to the pull bar 611 of the movable blade 61 to have the active rod 81 of the buffering device 80 set in a normally contracted condition and set the limiting block 82 at an innermost end of the limiting slots 722.

When the movable blade 61 of the hinge 60 is doing reciprocal rotation, the active rod 81 of the buffering device 80 is driven to extend/contract and thus causing the limiting block 82 to reciprocally slide within the limiting slots 722, so as to control an opening range of the hinge 60. (In the instant embodiment, the movable blade 61 of the hinge 60 can take a relative rotation of 0-90 degrees with respect to the fixed blade 62.)

Referring to FIGS. 3 and 5-7, the present invention can be installed on a locker or cabinet 90 mounted on a wall. The fixed plate 51 of the rail 50 is mounted to an inside surface of a door panel 92 and the movable blade 61 of the hinge 60 is attached to an access opening of a cabinet body 91. Thus, when the door panel 92 is opened, the door panel 92 is rotated upward as being supported by the pivot between the fixed blade 62 and the movable blade 61 of the hinge 60, thereby causing the movable blade 61 to rotate upward. The pull bar 611 of the movable blade 61 drives the limiting block 82 to slide outward and extends the active rod 81 of the buffering device 80 (under the action of air pressure inside the buffering device 80), so that the limiting block 82 is caused to slide to an end of the limiting slots 722 of the retention frame 70, making the door panel 92 parallel to a top surface of the cabinet body 91. Afterwards, a user may push the door panel rearward, and the movable plate 53 of the rail 60 is caused to slide with respect to the fixed plate, moving the door panel 92 toward the rear side of the cabinet body 91. In this way, opening and stowing the door panel 92 in a space above the top of the cabinet body 91 is realized. The operation is easy and the door panel 92 does not unexpectedly close when the cabinet is being accessed, making it safe in operation and use and also effort-saving. To close the door panel 92, the door panel 92 is first pulled forward and the door panel 92 is acted by a downward force induced by gravity to overcome the hydraulic force of the buffering device 80 so as to slowly close. The present invention uses the buffering device 80 to reduce the downward moving speed of the door panel 92 to make the door panel 92 closed in a gentle manner. Thus, no noise and damage to a user may occur.

Referring to FIGS. 5-8, in another embodiment, to enhance the practicability of the present invention and to provide the convenience of effort-saved operation, a tension spring 55 is arranged between the fixed blade 62 of the hinge 60 and the fixed plate 51 of the rail 50. The fixed blade 62 comprises a retention peg 621. One side of the fixed plate 51 forms a retention peg 511. Opposite ends of the spring 55 are respectively attached to the two retention pegs 621, 511. When the door panel 92 is pushed rearward, the returning spring force of the spring 55 helps reducing the force needed in pushing the door panel 92 rearward.

Having been described the present invention above, it is apparent that the present invention offers the following advantages:

(1) The present invention arranges a buffering device 80 between the rail 50 and the hinge 60 to buffer the downward movement and force of the door panel 92 in order to eliminate the problems of clamping and hurting people and generation of noise. The buffering device 80 also helps saving effort for opening the door panel 92.

(2) The present invention provides a retention frame 70 that forms limiting slots 722 for limiting the distance range that a limiting block 80 coupled to the hinge 60, so as to control the opening range of the door panel 92.

(3) The present invention arranges a tension spring 55 between the rail 50 and the hinge 60, which helps reducing the force needed in pushing the sliding movement of the door panel 92.

It is noted that what described above shows only a preferred embodiment of the present invention and does not intend to limit the scope of the present invention. For example, modification made on the type of the rail 50 or the type of the hinge 60 or the buffering device 80 is considered within the scope of the present invention. Thus, any modification that can be readily achieved by those having ordinary skills, such as replacing the pneumatic/hydraulic device of the buffering device 80 with a regular pneumatic device or a hydraulic device, is considered within the scope of the present invention as defined in the appended claims.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A hinged slide rail, comprising at least:

a rail, which comprises at least a fixed plate, a balled plate, and a movable plate, the balled plate being interposed between the movable plate and the fixed plate to allow the movable plate to do reciprocal sliding movement with respect to the fixed plate;

a hinge, which is mounted to a surface of the movable plate, the hinge comprising a movable blade and a fixed blade that are rotatably coupled to each other so that the movable blade is reciprocally rotatable with respect to the fixed blade, the fixed blade being fixed to an end of the movable plate, the movable blade having an end to which a pull bar is mounted;

a retention frame, which is mounted to the fixed blade and defines therein an accommodation space, the retention frame having an end forming two limiting slots;

a buffering device, which is received in the accommodation space of the retention frame, the buffering device comprising an active rod having an end forming a limiting block that is slidably received in the two limiting slots, the limiting block being coupled to the pull bar of the movable blade, whereby reciprocal rotation of the movable blade of the hinge drives extension/contraction of the active rod and thus inducing reciprocal sliding movement of the limiting block within the limiting slots, so as to control an opening range of the hinge.

2. The hinged slide rail according to claim 1, wherein a tension spring is arranged between the fixed blade of the hinge and the fixed plate of the rail.

3. The hinged slide rail according to claim 1, wherein the buffering device is selected from a group consisting of a pneumatic device, a hydraulic device, and a pneumatic/hydraulic device.

4. The hinged slide rail according to claim 1, wherein the active rod of the buffering device is normally contracted to set the limiting block at an innermost end of the limiting slots.

5. The hinged slide rail according to claim 1, wherein the retention frame forms in a central portion thereof a cylindrical accommodation space and has two sides from which lugs respectively extend, the lugs forming at least one fixing hole and one limiting slot, the two limiting slots being substantially parallel to each other.

6. The hinged slide rail according to claim 1, wherein the rail comprises a roller set at one end thereof.

7. The hinged slide rail according to claim 1, wherein the movable blade of the hinge forms a plurality of fixing holes.

* * * * *